US008287162B2

(12) United States Patent
Lu et al.

(10) Patent No.: US 8,287,162 B2
(45) Date of Patent: Oct. 16, 2012

(54) FOLDABLE TABLE LAMP

(75) Inventors: Wen-Hsiang Lu, Taipei Hsien (TW); Huai-Shan Gu, Shenzhen (CN); Ting Dong, Shenzhen (CN); Li-Tao Zhang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 383 days.

(21) Appl. No.: 12/788,325

(22) Filed: May 27, 2010

(65) Prior Publication Data

US 2011/0140640 A1 Jun. 16, 2011

(30) Foreign Application Priority Data

Dec. 11, 2009 (CN) ..... 2009 1 0311271

(51) Int. Cl.
*F21S 8/00* (2006.01)

(52) U.S. Cl. ..... 362/427; 362/276; 362/285; 362/287; 362/802; 362/418

(58) Field of Classification Search ..... 362/98, 362/99, 285, 287, 276, 410, 413, 414, 418, 362/427, 802
See application file for complete search history.

(56) References Cited

U.S. PATENT DOCUMENTS

| | | | | |
|---|---|---|---|---|
| 6,170,968 | B1 * | 1/2001 | Caswell | 362/469 |
| 8,152,344 | B2 * | 4/2012 | Gu et al. | 362/427 |
| 2007/0242468 | A1 * | 10/2007 | Leung | 362/410 |
| 2011/0051437 | A1 * | 3/2011 | Ng et al. | 362/427 |

FOREIGN PATENT DOCUMENTS

| | | |
|---|---|---|
| CN | 2110579 | 7/1992 |
| CN | 201133576 | 10/2008 |

* cited by examiner

*Primary Examiner* — Stephen F Husar
*Assistant Examiner* — James Cranson, Jr.
(74) *Attorney, Agent, or Firm* — Altis Law Group, Inc.

(57) ABSTRACT

A lamp includes a head, a support arm and a base. The head includes a light emitting member. The support arm is rotatably connecting to the head. The support arm includes a first pushing member and a second pushing member. The base includes a moveable contact and a stationary contact. The moveable includes a spring tab. When the support arm is rotated to a first position, the first pushing member abuts against the spring tab to be deformed, and the spring tab connects to the stationary contact. The light emitting member is in a power on state. When the support arm is rotated to a second position, the second pushing member abuts against the spring tab to be deformed, and the spring tab disengages from the stationary contact. The light emitting member is in a power off state.

7 Claims, 7 Drawing Sheets

FOLDABLE TABLE LAMP

BACKGROUND

1. Technical Field

The present disclosure relates to table lamps and, particularly, to a foldable table lamp having a power switched off when the table lamp is folded.

2. Description of Related Art

A foldable table lamp can be folded when not in use. Although conventional foldable table lamps satisfy basic requirements, a foldable table lamp, which includes a power switch that can be switched off when the table lamp is folded, is still needed.

BRIEF DESCRIPTION OF THE DRAWINGS

The components of the drawings are not necessarily drawn to scale, the emphasis instead being placed upon clearly illustrating the principles of a foldable table lamp. Moreover, in the drawings, like reference numerals designate corresponding parts throughout several views.

DETAILED DESCRIPTION

Figure 1:
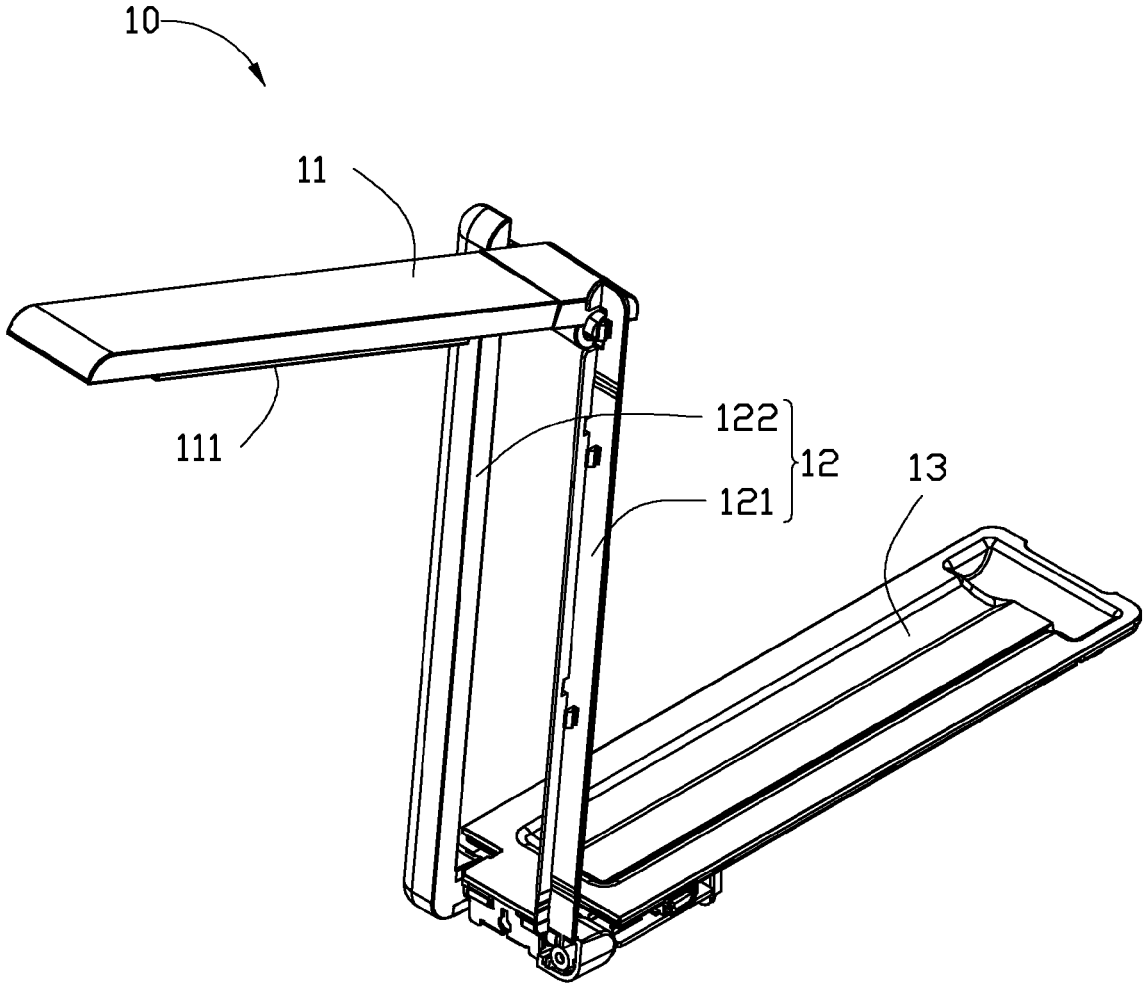
FIG. 1 is an isometric view of a foldable table lamp in accordance with an exemplary embodiment.
Figure 2:
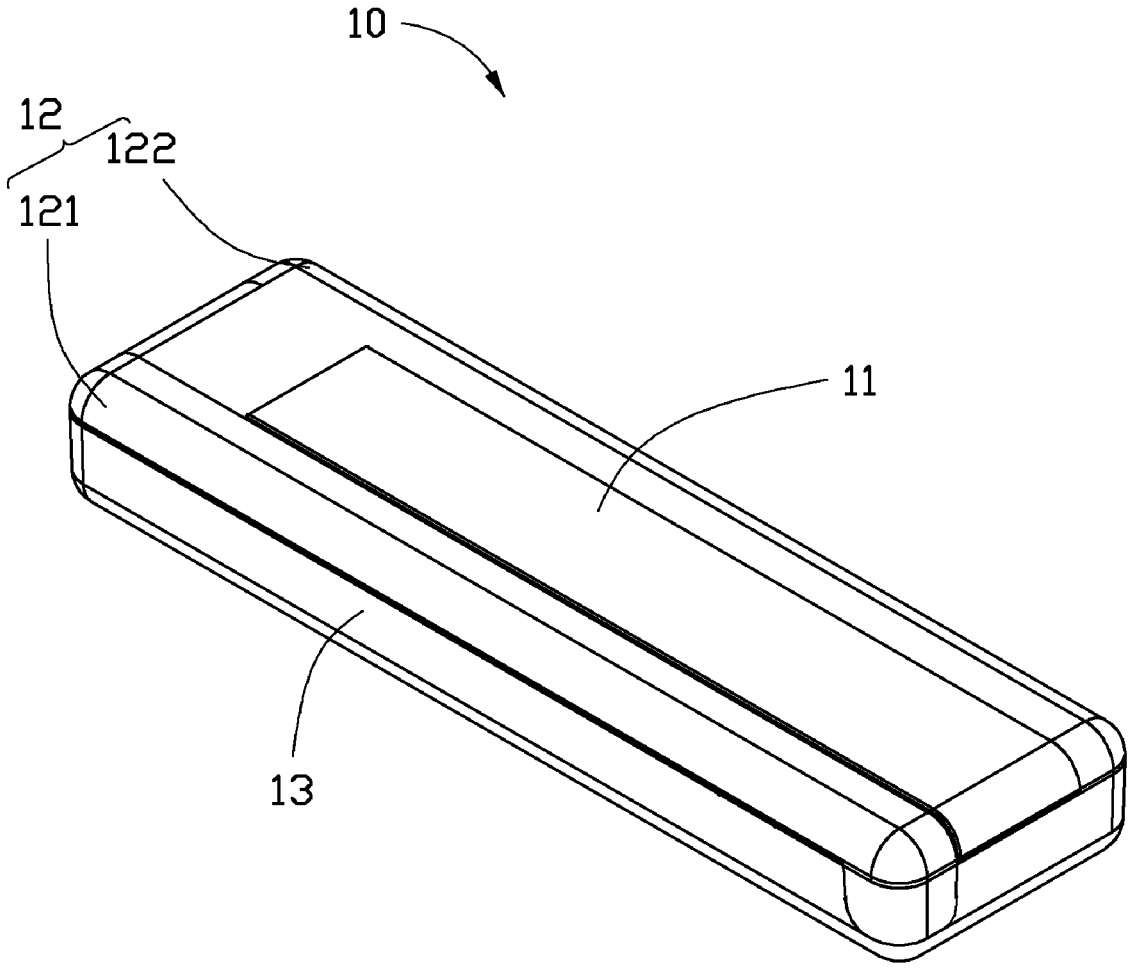
FIG. 2 shows the table lamp of FIG. 1 in a folded state.

Embodiments of the present disclosure will now be described in detail below, with reference to the accompanying drawings. Referring to FIGS. 1-2, a lamp 10 includes a head 11, a support arm 12 and a base 13. The head 11 is rotatably connected to one end of the support arm 12. The support arm 12 is rotatably connected to the base 13.

The head 11 includes a light emitting member 111. The support arm 12 includes a first bar 121 and a second bar 122 substantially parallel to the first bar 121. In the embodiment, the distance between the first bar 121 and the second bar 122 is the same as the width of the head 11. The head 11 can thus rotate to be fully received between the bar 121 and 122.

Figure 3:
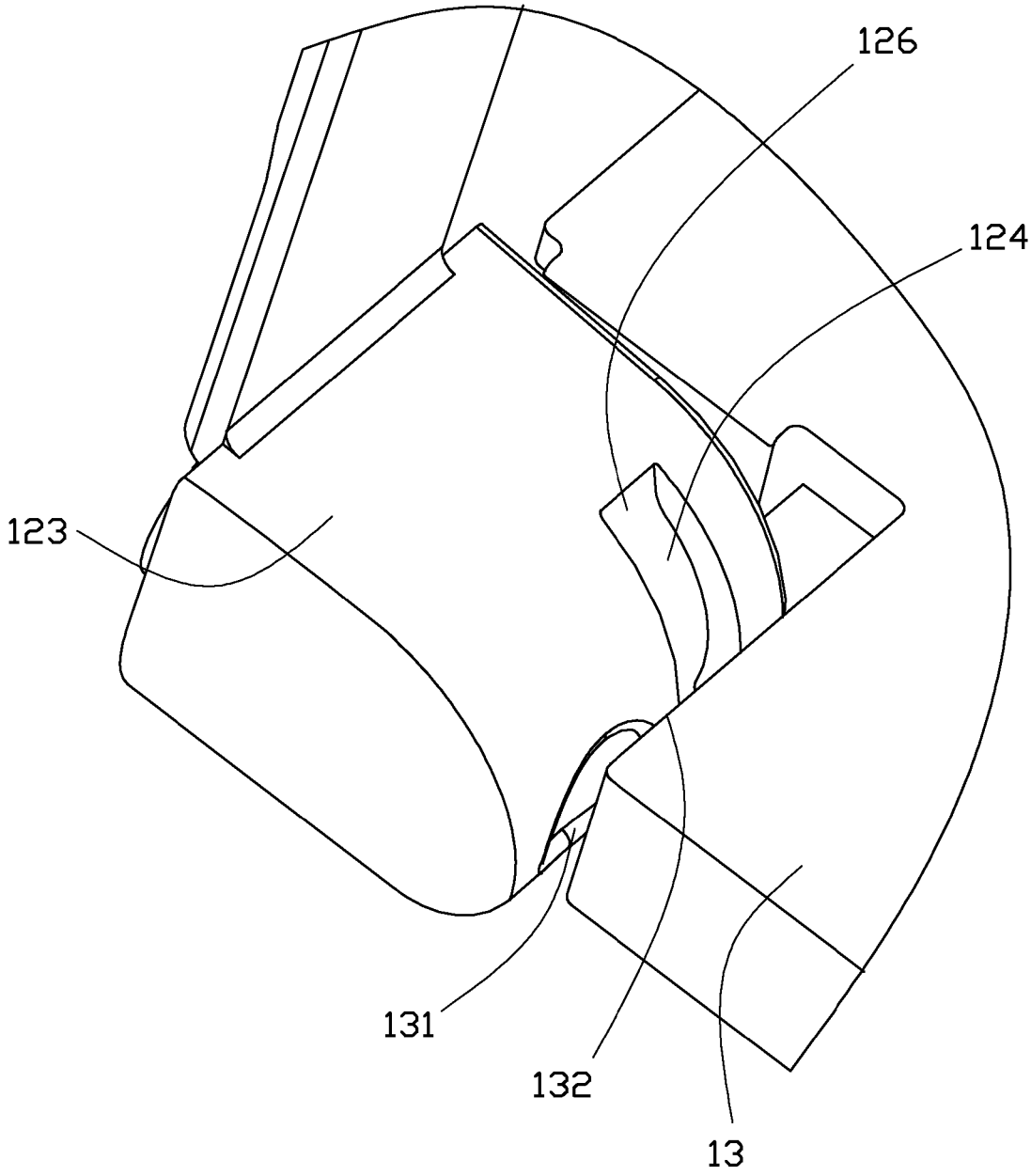
FIG. 3 is a partial, isometric view of the table lamp of FIG. 1, showing a connecting end and a base.
Figure 4:
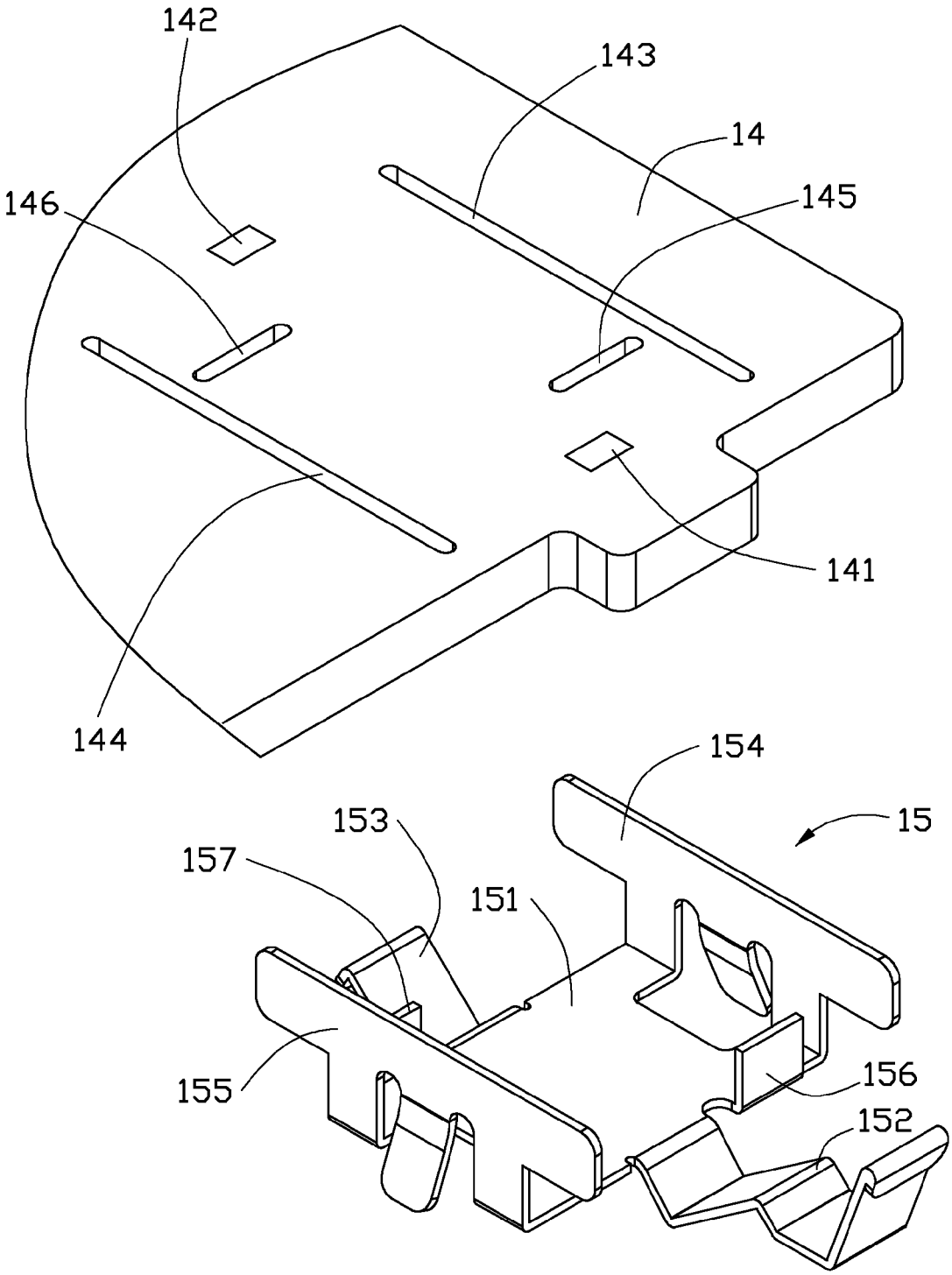
FIG. 4 is a partial, exploded view of the table lamp of FIG. 1, showing a movable contact and a circuit board.
Figure 5:
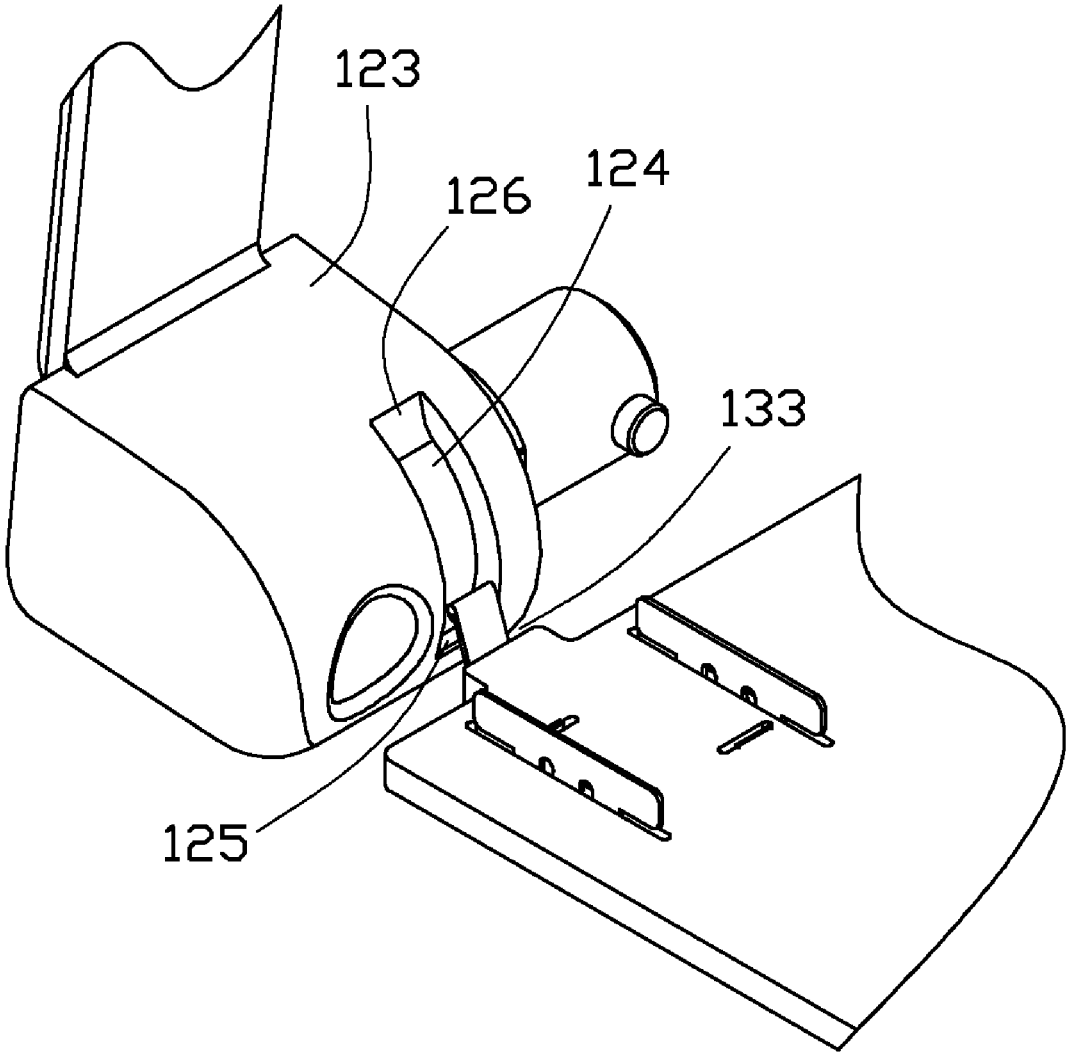
FIG. 5 is a partial, isometric view of the table lamp of FIG. 1 in an unfolded state, showing the moveable contact and a connecting end from a first perspective.

Referring to FIGS. 3-5, the bar 121 and 122 each includes a connecting end 123 that is rotatably connected to the base 13. The outer surface of the connecting end 123 defines a groove 124 extending around its rotating axis. Each of the connecting ends 123 includes a first pushing member 125 and a second pushing member 126. In the embodiment, the first pushing member 125 is the lower end of the groove 124, and the second pushing member 126 is the upper end of the groove 124.

To receive the connecting end 123, the base 13 defines a receiving space 131.

The space 131 includes sidewall 132. The sidewall 132 and the connecting end 123 form a gap 133 (see FIG. 5). The base 13 further includes a circuit board 14 and a movable contact 15.

The circuit board 14 includes a first stationary contact 141, a second stationary contact 142, a first slot 143, a second slot 144, a first opening 145, and a second opening 146. The contact 141 is adjacent to an edge of the circuit board 14. The first slot 143 and the second slot 144 extend along a lengthwise direction of the circuit board 14. The first opening 145 and the second opening 146 extend along a widthwise direction of the circuit board 14. When the stationary contact 141 and the stationary contact 142 are electrically close, the light emitting member 111 is in a power on state. When the stationary contact 141 and the stationary contact 142 are electrically open, the light emitting member 111 is in a power off state.

The movable contact 15 includes a main body 151, a spring tab 152, a arm 153. The spring tab 152 extends from one edge of the main body 151, and the arm 153 extends from an opposite edge of the main body 151. The movable contact 15 further includes a first sidewall 154, a second sidewall 155, a first mounting tab 156 adjacent to the spring tab 152, and a second mounting tab 157 adjacent to the arm 153. The end of the spring tab 152 protrudes from the sidewall 132 of the receiving space 131, and is movably received in the gap 133. The arm 153 is in contact with the static contact 142. The first sidewall 154 is securely received in the first slot 143, and the second sidewall 155 is securely received in the second slot 144. The first mounting tab 156 is securely received in the first opening 145, and the second mounting tab 157 is securely received in the second opening 146.

Figure 6:
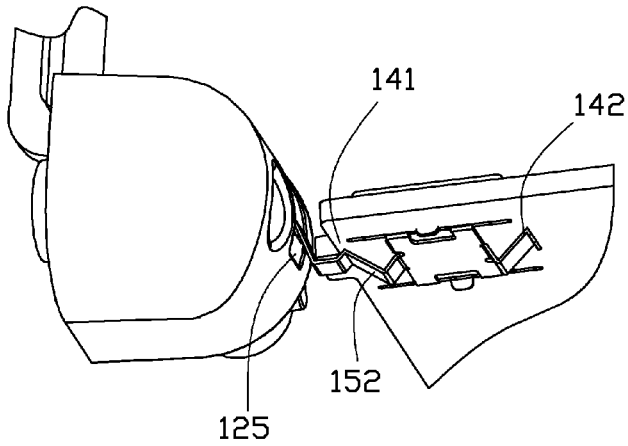
FIG. 6 is a partial, isometric view of the table lamp of FIG. 1 in an unfolded state, showing the moveable contact and the connecting end from a second perspective.

Referring to FIG. 6, when the table lamp 10 is in an unfolded state. The end of the spring tab 152 abuts against the end 125 and is slightly deformed. The spring tab 152 stays in contact with the first stationary contact 141. The stationary contact 141 and 142 thus are electrically closed. Therefore, the light emitting member 111 is in a power on state.

Figure 7:
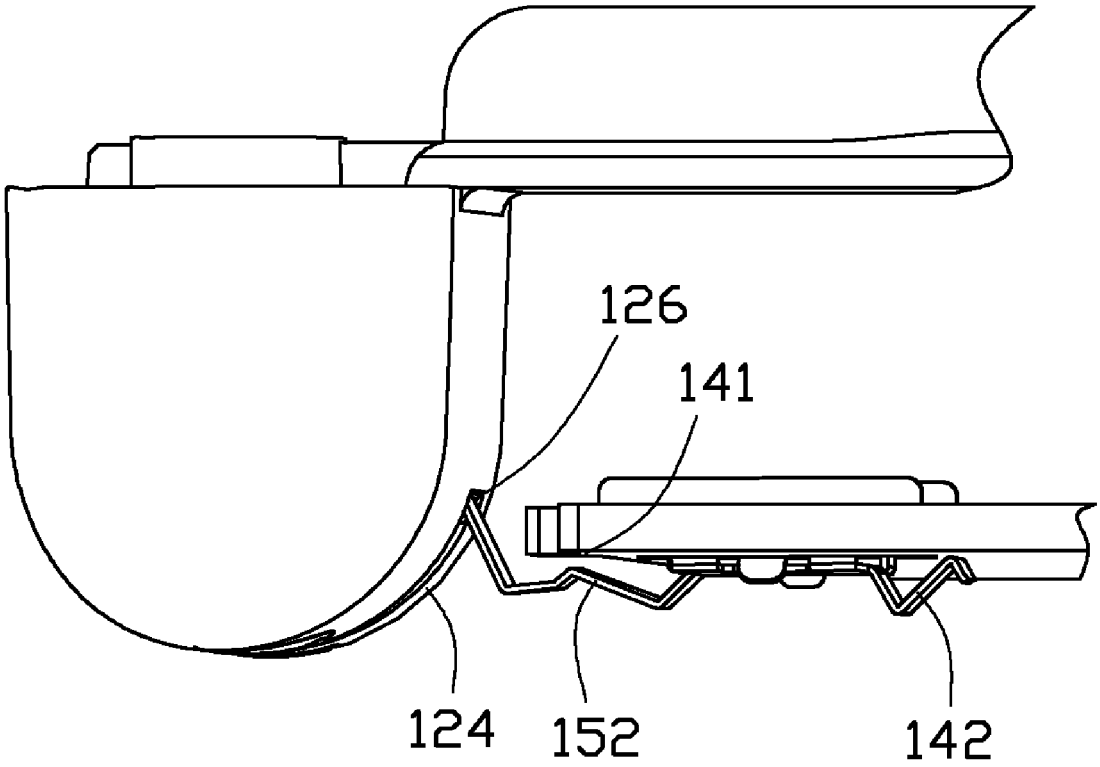
FIG. 7 is a partial, isometric view of the table lamp of FIG. 1 in a folded state, showing the moveable contact and the connecting end.

Referring to FIG. 7, the support arm 12 is rotated from the first position to the second position. In the embodiment, the first position is where the support arm 12 stays in a unfolded state as shown in FIG. 6. The second position is where the support arm 12 stays in a folded state as shown in FIG. 7. The end 125 moves away from the spring tab 152, while the end 126 abuts against the end of the spring tab 152, pushing the spring tab 152 to deflect away from the stationary contact 141. The stationary contact 141 and 142 thus become electrically open. Therefore, the light emitting member 111 is changed to a power off state.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A lamp, comprising:

a head comprising a light emitting member;

a support arm rotatably connected to the head and comprising a first pushing member and a second pushing member; and a base rotatably connected to the support arm and comprising a movable contact and a stationary contact, the moveable contact comprising a spring tab;

wherein when the support arm is rotated to a first position, the first pushing member abuts against the spring tab, the spring tab is deformed and contacts the stationary contact, the light emitting member is in a power on state; when the support arm is rotated to a second position, the second pushing member abuts against the spring tab, the spring tab is deformed to disengage from the stationary contact, the light emitting member is in a power off state.

2. The lamp as described in claim 1, wherein the support arm comprises a first bar and a second bar, the distance between the first bar and the second bar is the same as the width of the head.

3. The lamp as described in claim 1, wherein the support arm comprises a connecting end, the connecting end defines a groove extend around its rotating axis, the first pushing member is the lower end of the connecting end, and the second pushing member is the upper end of the connecting end.

4. The lamp as described in claim 1, wherein the movable contact comprises a main body and an arm, the spring tab extends from an edge of the main body, and the arm extends from the opposite edge of the main body.

5. The lamp as described in claim 4 further comprising a circuit board, wherein the circuit board further comprises a second stationary contact, the arm is in contact with the second stationary contact.

6. The lamp as described in claim 1, wherein the movable contact comprises a first sidewall and a second sidewall, the circuit board comprises a first slot and a second slot, the first sidewall is securely received in the first slot, and the second sidewall is securely received in the second slot.

7. The lamp as described in claim 3, wherein the base further defines a receiving space, the connecting end is received in the receiving space.

* * * * *